United States Patent [19]

Bender et al.

[11] Patent Number: 4,866,945

[45] Date of Patent: Sep. 19, 1989

[54] COUNTERTOP WATER COOLER

[76] Inventors: Richard S. Bender, 7210 Jordan Ave., G-18, Canoga Park, Calif. 91303; Lawrence Pleet, No. 9 Flintlock La., Bell Canyon, Calif. 91307

[21] Appl. No.: 333,090

[22] Filed: Apr. 4, 1989

Related U.S. Application Data

[63] Continuation of Ser. No. 238,827, Aug. 31, 1988, abandoned.

[51] Int. Cl.[4] ..... F25B 21/02

[52] U.S. Cl. ..... 62/3.61; 62/3.64; 62/389; 62/395; 222/146.6

[58] Field of Search ..... 222/146.6; 62/3, 389, 62/390, 394, 395

[56] References Cited

U.S. PATENT DOCUMENTS

| | | | |
|---|---|---|---|
| 3,243,965 | 4/1966 | Jepson | 62/395 X |
| 3,250,433 | 5/1966 | Christine et al. | 62/3 |
| 3,310,953 | 3/1967 | Rait | 62/3 |
| 3,314,242 | 4/1967 | Lefferts | 62/3 |
| 3,325,058 | 6/1967 | West, Jr. | 222/146 |
| 3,811,294 | 5/1974 | Taylor | 62/390 |
| 4,274,262 | 6/1981 | Reed et al. | 62/3 |
| 4,311,017 | 1/1982 | Reed et al. | 62/3 |
| 4,320,626 | 3/1982 | Donnelly | 62/3 |
| 4,346,562 | 8/1982 | Beitner | 62/3 |
| 4,757,920 | 7/1988 | Harootian, Jr. | 222/146.6 |

*Primary Examiner*—Lloyd L. King

*Attorney, Agent, or Firm*—Poms, Smith, Lande & Rose

[57] ABSTRACT

A countertop cooler for standard size water bottles where the plastic bottle has a spigot at the lower front end of said bottle which allows withdrawal of water, said water bottle enclosed in a refrigeration case for cooling; said refrigeration case having a removable top in which said bottle and removable top section of said cooler is held in place by a means for securing said removable section in place to close the refrigeration case. Within the refrigeration case is a metal conductive cooling surface member extending from the rear of said case extending along at least a substantial portion of the bottom and sides of said refrigeration case, cooling said water bottle by conduction, with a cooling means preferably thermoelectric incorporated within said cooler; and in engagement with the metal cooling surface member.

21 Claims, 7 Drawing Sheets

FIG. 1
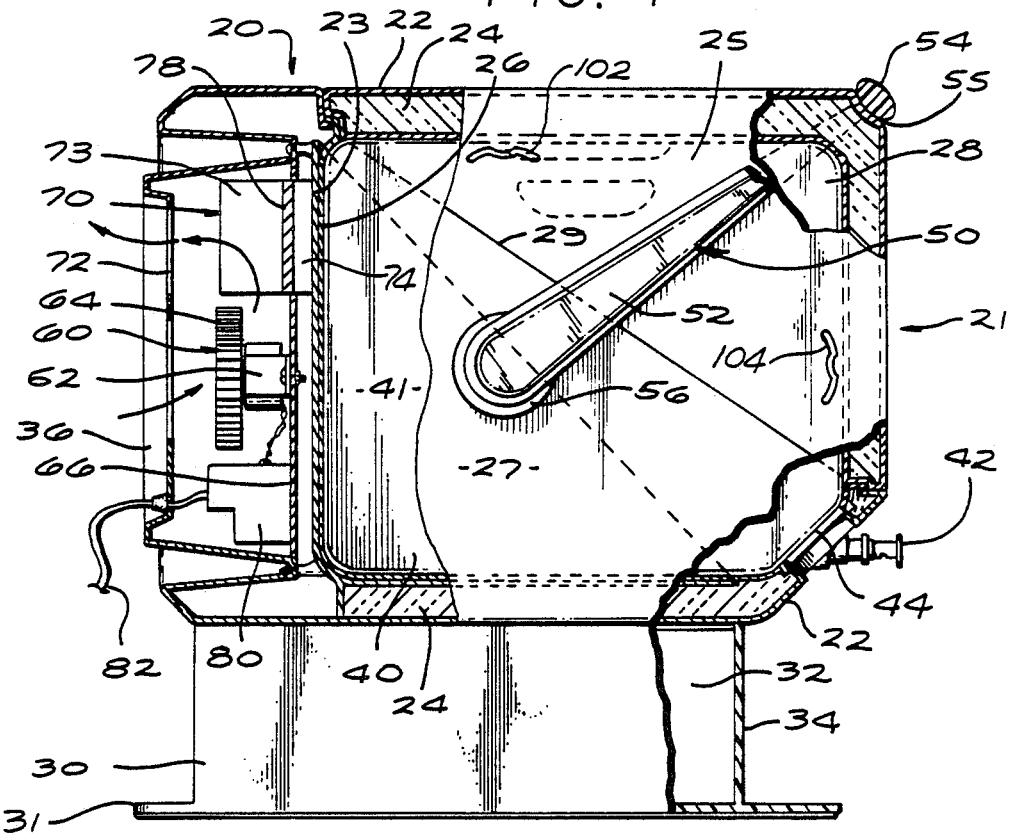
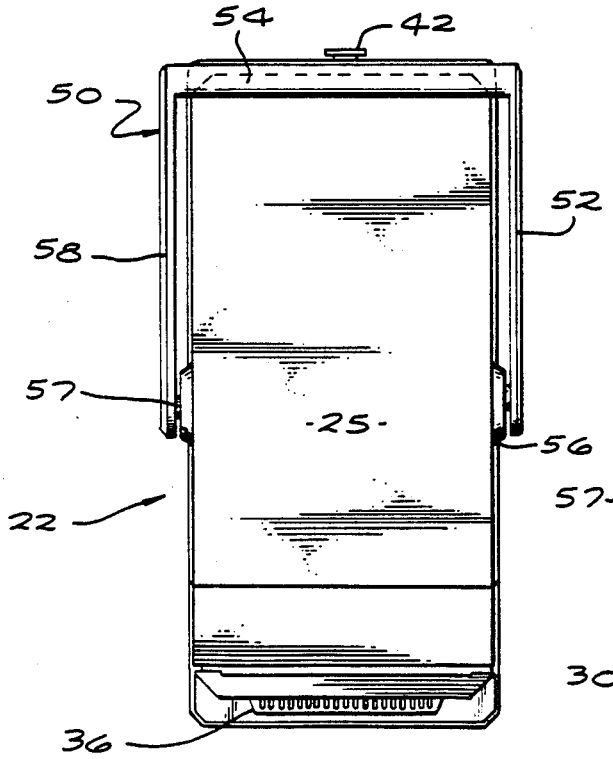
FIG. 2
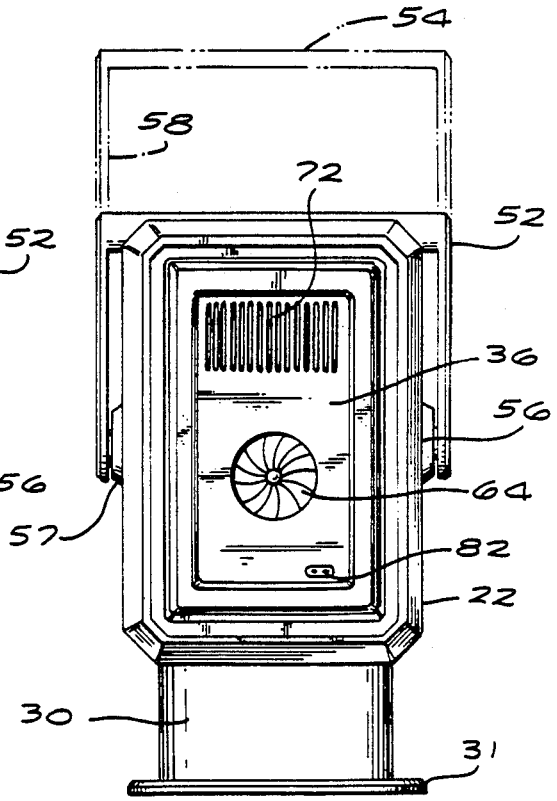
FIG. 3

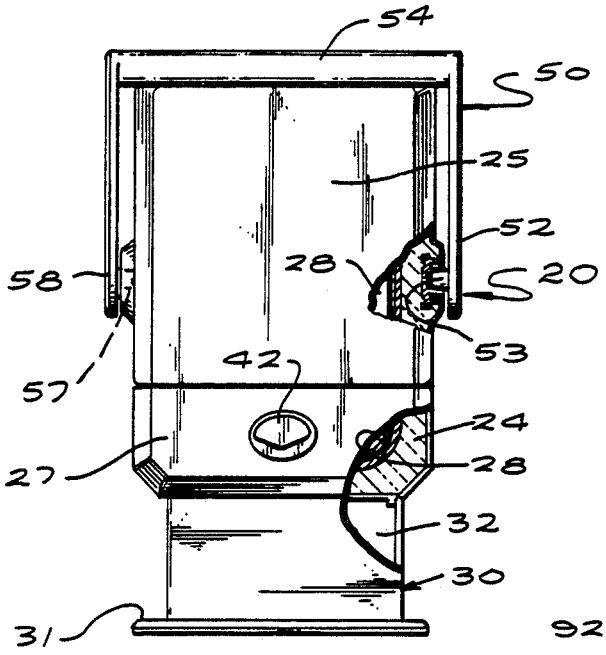
FIG. 4
FIG. 20
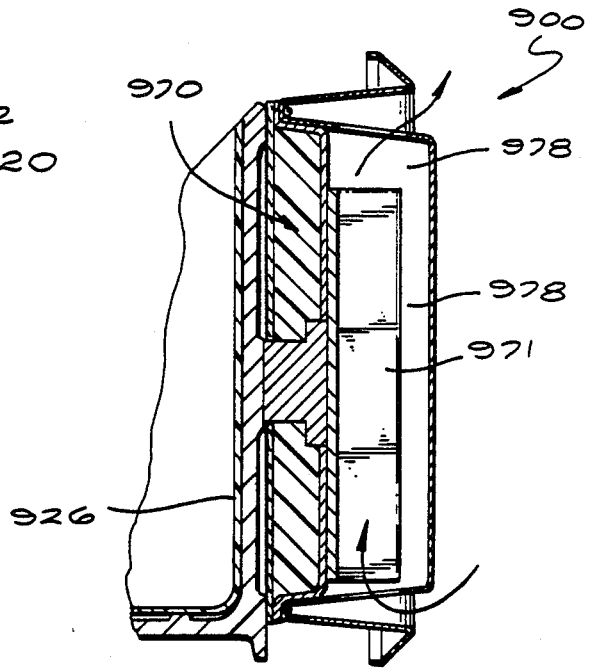
FIG. 21
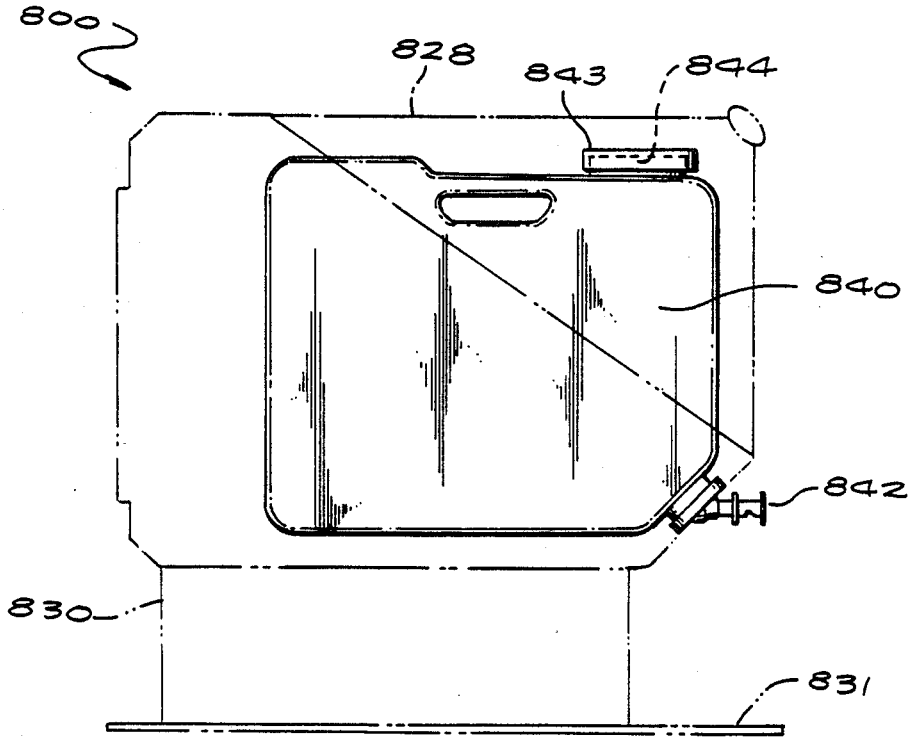

FIG. 5
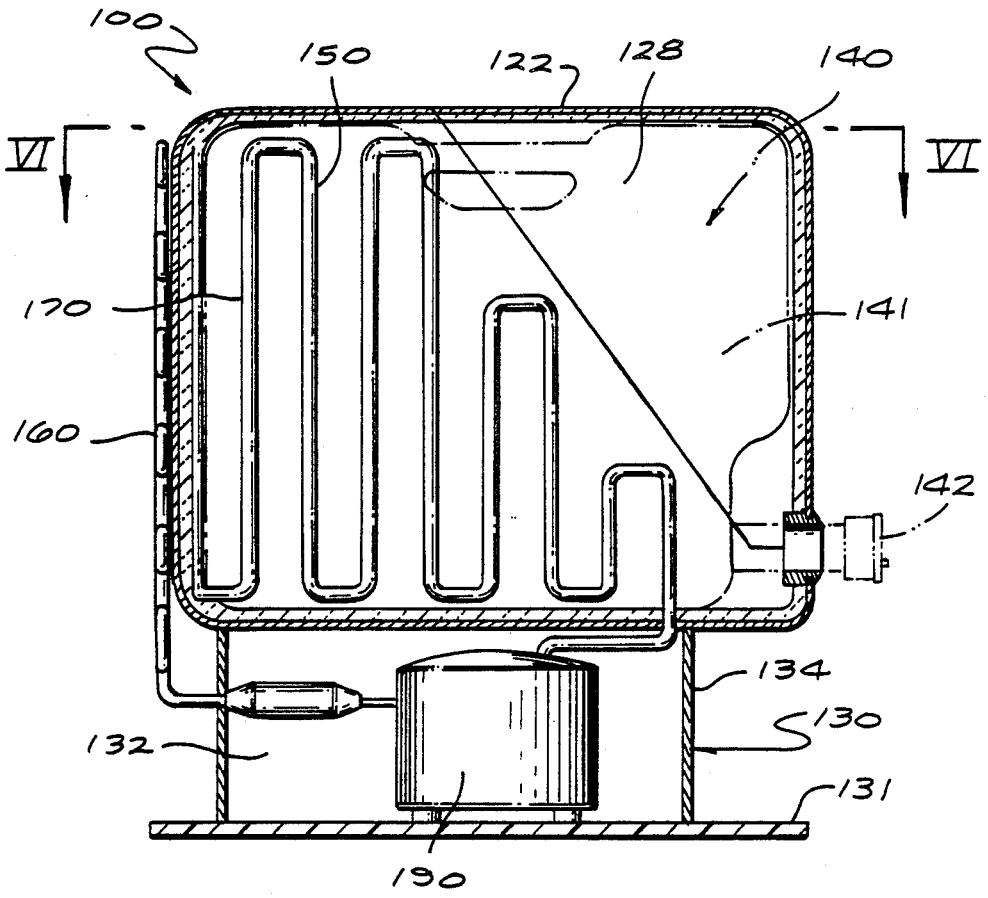
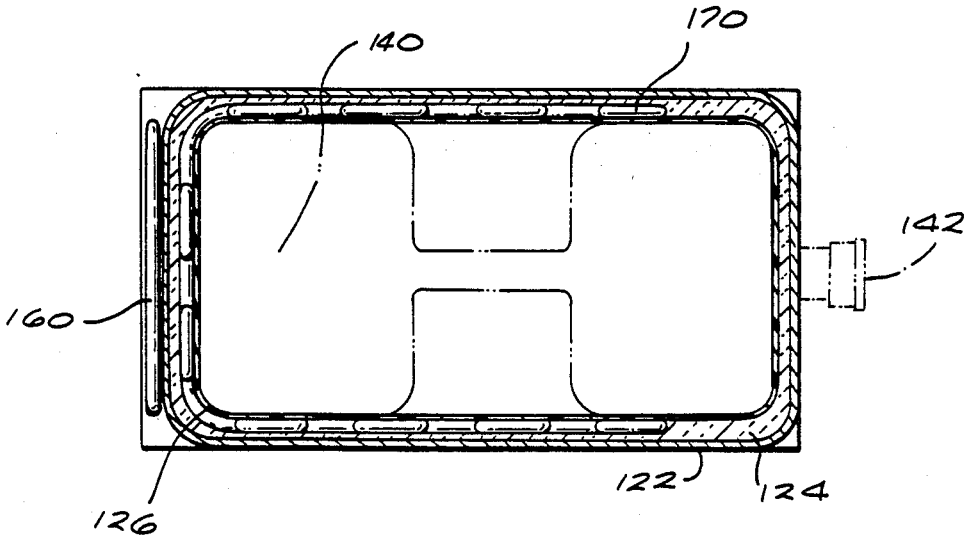
FIG. 6

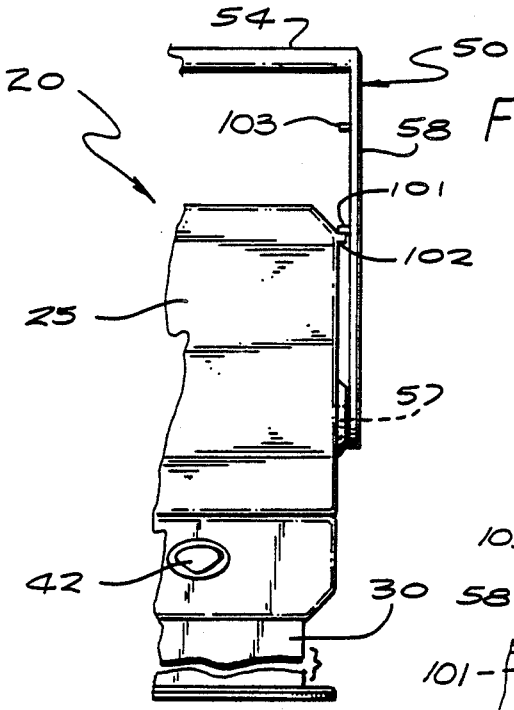
FIG. 14
FIG. 15
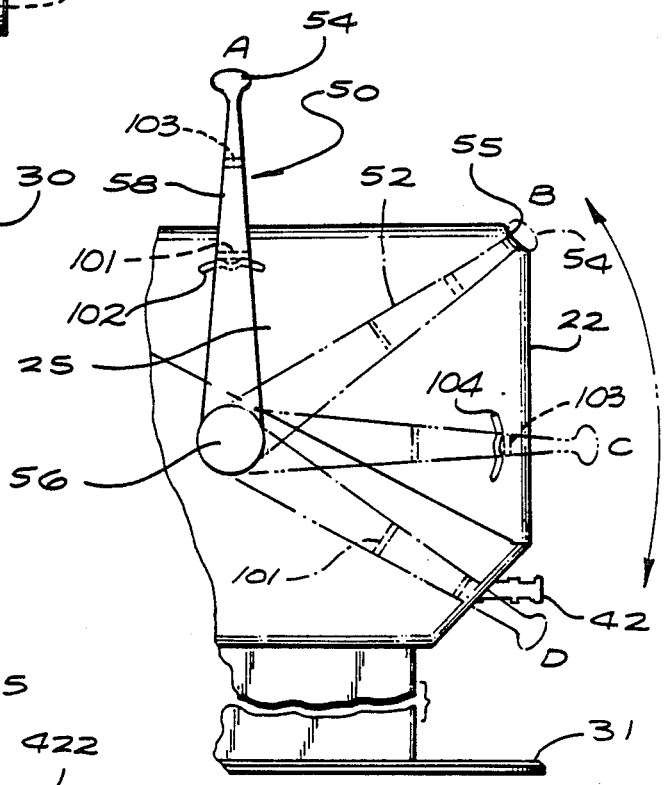
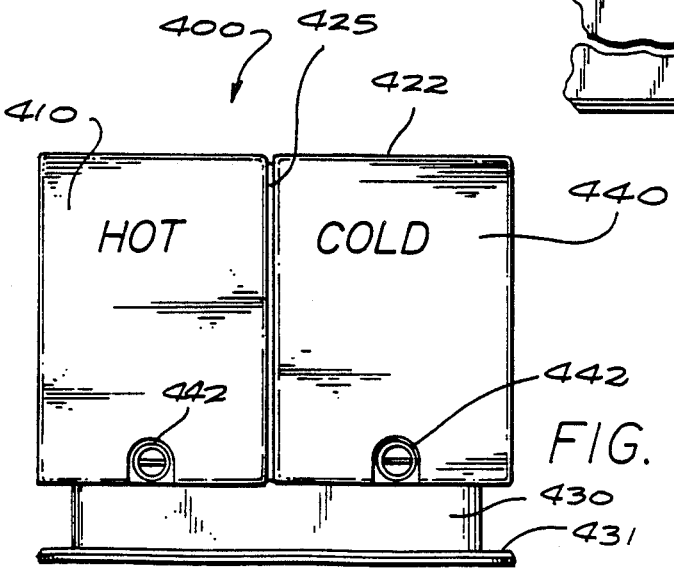
FIG. 16

COUNTERTOP WATER COOLER

RELATED PATENT APPLICATIONS

This is a continuation of U.S. patent application Ser. No. 238,827, filed Aug. 31, 1988, now abandoned.

BACKGROUND OF THE INVENTION

The increased pollution of water systems throughout the country has created a tremendous demand for clean potable water of a known source. Health fears have risen as a result of the contamination of various domestic water supply systems with chemicals which either cause the closure of the system or increase the health risks to its users.

Stand alone water coolers have been known in the office environment for many years. Originally, purchased and utilized as a convenience, it has now become increasingly popular due to health fears concerning the piped in municipal water supply. In the home, there has been an increased demand for bottled water from a known source. The water has been typically sold as spring, mountain, purified, or distilled water. While the demand for bottled water has increased in the home, it has not replaced the convenience of tap water available from the municipal supplier.

Suppliers of spring water have attempted to supply the domestic user with water bottles and coolers like those found in the office environment. U.S. Pat. Nos. 4,646,944, 4,516,693, 4,373,647, 4,293,082, 3,966,093 and 3,843,021 are all variations on the office environment cooler, a stand alone unit which takes up unavailable floor space in the typical kitchen.

In supermarkets, two and one-half gallon plastic containers of spring water or purified water, with attached spigots, are now widely available. However, the consumer has had to store these bottles of water in their refrigerator, requiring the continual opening and closing of the refrigerator to obtain water. This inconvenience has resulted in many people doing without the bottled water. Additionally, the bottles themselves have been designed to hold large quantities of water and therefore occupy a large amount of space in the refrigerator.

The disadvantages of bottled water has resulted in less use than would occur if delivery of the water would be similar to that of the domestic tap. The invention herein obviates the above disadvantages of storing bottled water in the family refrigerator, as well as making its delivery for usage more practicable.

SUMMARY OF THE INVENTION

The invention may be summarized as a liquid chiller or countertop cooler for the standard sized plastic water bottles which are approximately 6 inches wide, 12 inches deep, and 10 inches in height with the capacity of 2½ gallons. These bottles are provided with a spigot at the lower front end of the bottle, the spigot extending from the front of the cooler when said bottle is enclosed in the cooler refrigeration case. The refrigeration case has a removable section including a portion covering more than one-half of the top of said bottle and most of the front thereof which engages with a base section. This permits the easy placement of the water bottle in the refrigeration case and it also makes for easy removal of the water bottle therefrom. The removable section is held in place by a means such as a handle for securing said removable section in place to close said refrigeration case. Within said refrigeration case is a metal heat conductive member which is in the rear of the case and extends along at least a substantial portion of the bottom and sides of said refrigeration case. The metal conductor member cools said bottle by conduction; said cooling occurs through the use of a cooling means incorporated into the countertop cooler.

The countertop cooler may be provided with a thermoelectric cooling unit which is located at the rear of the cooler and which is in substantially direct cooling engagement with the metallic heat conducting member enclosing the rear of the water bottle. The thermoelectric cooling unit may have external fins at the rear of the unit, with these fins being cooled either by convection or with a supplemental air flow from a fan. The thermoelectric cooling is particularly adapted to the present cooler system in which cooling is accomplished by direct heat flow through thermal conduction.

Other features and aspects of this invention may selectively include the following:

1. A pivoted locking handle which may engage the front upper corner of the unit to firmly hold the removable section in place, and may be provided with additional detents which engage mating protrusions or recesses on the removable section near the top and near the front of the removable section of the cooler. The handle may be used for carrying the cooler or moving it around on a counter.

2. The cooler may have a conventional compressor type cooling unit instead of a thermoelectric unit, with the cooling coils of the cooler closely enclosing the rear, sides, and bottom of the plastic water bottles which are to be cooled.

3. The cooler is preferably provided with a base which raises the water bottle above the counter by a few inches, with the total height of the cooler unit being less than 16 inches, so that it may be slid under the usual kitchen cabinets The front of the cooler may be advanced to near the edge of a counter to facilitate filling tall receptacles.

4. Hot and cold units may be combined in single side-by-side assembly with the thermoelectric element heating one of the units and cooling the other one.

5. A reusable two and one-half gallon rectangular plastic bottle may be used, with a large removable cap, preferably with screw threads, on the forward portion of the bottle, and with the overall configuration of the bottle otherwise substantially that of the presently available bottles of water mentioned above. Any suitable beverage, such as iced tea, mineral water or any other potable liquid may be cooled in these units.

Other objects, features and advantages of the invention will become apparent from a consideration of the following detailed description, and from the accompanying drawings.

BRIEF DESCRIPTION OF THE DRAWINGS

FIG. 1 is a side view of a countertop cooler illustrating the principles of the present invention;

FIG. 2 is a top view of the countertop cooler of FIG. 1;

FIG. 3 is a rear view of the countertop cooler of FIGS. 1 and 2;

FIG. 4 on sheet 7 of the drawings is a front view of the countertop cooler of FIGS. 1–3;

FIG. 5 is a cut-away cross-sectional view showing a countertop cooler using a conventional compression type refrigeration system;

FIG. 6 is a cross-sectional top view through plane VI—VI of FIG. 5;

FIG. 14 is a cutaway showing one locking position of the lock handle utilized to secure the removable section of the refrigeration case of FIG. 1, to the base thereof;

FIG. 15 illustrates the multi-position locking capability of the lock handle of the countertop cooler of FIG. 14;

FIG. 16 illustrates a side-by-side case holding two plastic bottles of water, with the left side holding hot water and the right side holding cold water and energized by a thermoelectric unit;

FIG. 20 illustrates convection air flow through the rear of a thermoelectric embodiment of a cooler; and FIG. 21 is a schematic showing an embodiment of a countertop water cooler with a refillable plastic bottle and spigot system.

DETAILED DESCRIPTION

Figure 7:
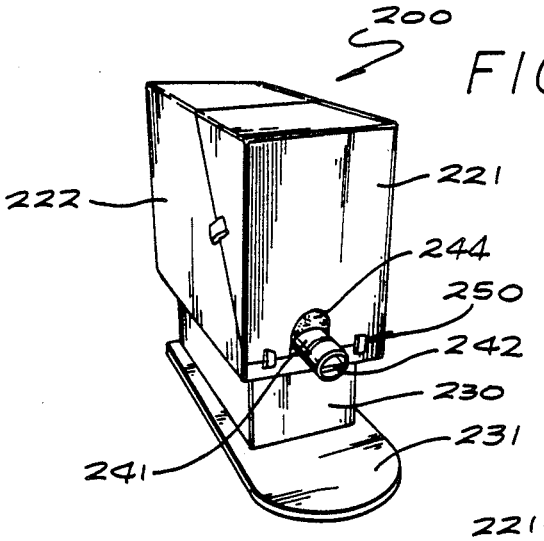
FIG. 7 is a front perspective view of an alternative embodiment of a countertop cooler illustrating the principles of the invention.

Referring to FIG. 1 of the drawings, countertop cooler 20 is shown in a side view with cutaway cross-sections. The countertop cooler 20 has an upper enclosure case 21 with an exterior surface 22, an interior cavity 28 into which water bottle 40 fits, and an interior thermally conductive liner or surface 26 in intimate contact with bottle 40. The enclosure has insulation 24 between exterior surface 22 and interior thermally conductive surface 26, typically a conductive plastic or metallic liner which is in intimate contact with water bottle 40 and covers a conductive metal member 23 preventing the contact of moisture thereon. The conductive member 23 and liner 26 contour to the approximate shape of bottle 40, exclusive of the bottle's top surface. The water bottle 40 fits into enclosure area 28. Spigot 42 which is part of the standard plastic water bottle 40, enables the water 41 to be drained from bottle 40. The water bottle 40 sits within upper enclosure case 21 on base 30 which has a lower flange 31. Base 30 is constructed with a thin sidewalls 34 and an interior cavity 32 within base 30, which may be employed for the storage of cups or for the mounting of ancillary components.

The upper front of the unit 21 is a removable section 25, to permit the mounting and removal of the 2½ gallon bottles 40. Removable section 25 is held in place by lock handle 50. With the lock handle 50 as shown in FIG. 1, the removable section 25 is very securely held in place, by the engagement of the lockbar portion 54 of handle 50 with the recess 55 in the upper front corner of section 25. A lower section 27 which partially encloses water bottle 40 mates with the removable section 25 along mating line 29. The annular position of lock handle 50 will determine the removability of section 25, as discussed in greater detail hereinbelow. The embodiment shown in FIG. 1 utilizes a thermoelectric cooling device 70 mounted on the rear of the countertop cooling unit 20. Thermoelectric cooling device 70 is mounted in the rear wall of upper enclosure 21 to ensure intimate contact with the aluminum heat transfer liner 23 (discussed below) and the interior thermally conductive liner 26. The thermoelectric module 78 forming part of unit 70, as utilized herein may be purchased from Material Electronic Products Corporation of Trenton, N.J. Optional spacer 74 of thermally conductive metal is mounted between thermoelectric module 78 and conductive plate 23. The thermoelectric cooling device 70 provides a solid state thermoelectric cooling system for cooling the conductive plate 23 and liner 26 which draws heat out of the water 41 in plastic water bottle 40, causing water 41 to cool, while concurrently heating fins 73 which extend to the rear. The centrifugal fan system 60 pulls air through screen back plate 36 and draws heat away from the fins 73 of thermoelectric device 70 and expels air through flow area 72. Electrical power is supplied to the electric fan motor 62 by transformer 80 from wire 82. Fan motor 62 and transformer 80 are supported on mounting plate 66. Seal 44 prevents leakage of air between interior cavity 28 and the ambient air, around spigot 42.

FIG. 2 is a top view of the countertop cooling unit 20 shown in FIG. 1. FIG. 2 specifically shows the locking handle 50 with its side elements 58 and 52 which are mounted to axial mounts 57 and 56. The locking bar 54 of handle 50 is locked at the upper front corner of the removable upper section 25.

FIG. 3 shows a rear view of cooling unit 20 of FIG. 1. This view illustrates the back end airflow panel 36 and fan blades 64, as well as base 30 and its lower flange or base plate 31.

FIG. 4 on sheet 7 of the drawings is a front view of countertop cooling unit 20, shown in FIGS. 1-3. Illustrated is spigot 42, insulation 24, and interior area 28. Additionally, lock handle 50 with side bars 52, 58 and lockbar 54 are shown with bearing 53 associated with side bar 52 in cross section. The position shown is that which locks removable section 25 in intimate mating contact with lower section 27, as shown in FIG. 1.

FIG. 5 is a side view in cross section of an alternative embodiment 100 of the invention herein. The countertop cooling unit 100 utilizes conventional refrigeration unit 150 which has a compressor 190, which fits within base cavity 132, evaporation cooling coils 170, and condensing coils 160. Within the traditional refrigeration system the evaporator 170 pressurized with refrigerant is allowed to expand, boil and evaporate. During the change of state from a liquid to a gas, energy, in the form of heat is absorbed. Compressor 190 is the refrigerant pump and recompresses the gas back into a liquid. Condenser 160 expels the heat absorbed by the evaporator plus the extra heat added by compressor 190 to the environment or ambient The operation of conventional refrigerating unit enables a cooling of the water 141 in plastic water bottle 140.

Concerning my reference numerals employed in the present specification, in FIGS. 1–4, certain reference numerals for parts such as base 30 and water bottle 40 were employed; and in FIG. 5 these parts bear reference numerals with a different prefix, i.e., base 130 and water bottle 140. More generally, throughout the present specification the same reference numerals will be employed, for corresponding parts in different embodiments, but with a different prefix digit in the "hundreds" column.

FIG. 6 is a top view taken along plane VI—VI of FIG. 5, of the countertop cooling unit 100 utilizing a conventional refrigeration unit 150. The plastic water bottle 140, evaporating coils 170, condensing coils 160, and thermally conductive inner liner 126 are shown.

The embodiment shown here, as in that of FIGS. 1–4, require that the water bottle be placed into the enclosure by spigot first. Each of the drawings show the requirement that spigot 42 in FIG. 1, spigot 142 in FIG. 5, have to be inserted first, and then the rest of the plastic water bottles 40 and 140, follow into cavities 28 and 128 respectively.

FIGS. 7 through 10 show another alternative embodiment 200 wherein front section 221 is readily removable leaving the water bottle 240 resting within section 222 which is supported by base 230 which sits on base plate 231. Retention tabs 250 may be provided to hold the removable section 221 in place. The removable section 221 has a central notch to accommodate spigot 242.

Figure 8:
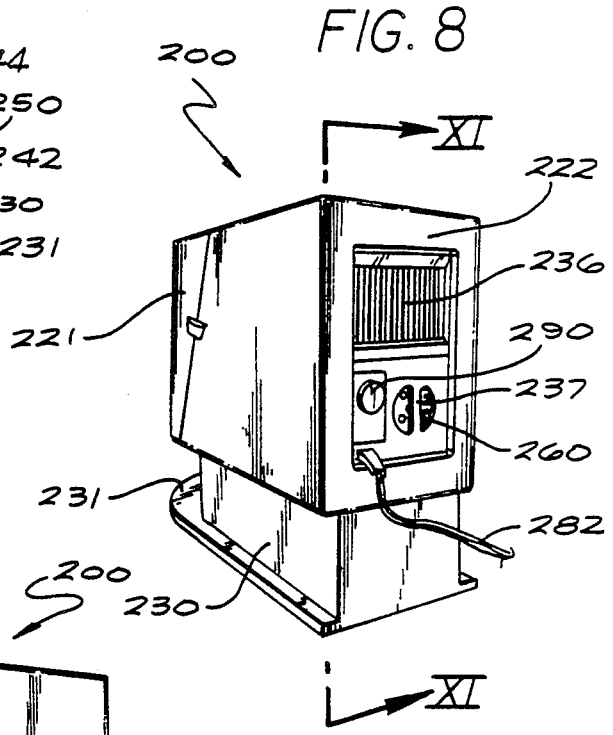
FIG. 8 is a rear perspective view of the countertop cooler of FIG. 7.

FIG. 8 shows the rear of unit 200, which has fan 260 bringing in cool air through opening 237, exiting through opening 236, and the water being cooled by a thermoelectric cooling device (not shown) such as that of FIGS. 1–4. The flow of air from inlet 237 to grill 236 brings in cool air and expels warm air. Thermostat control 290 enables the setting of a specific degree of coolness to which the water will be cooled. Supply wire 282 brings the necessary power to the thermoelectric device (not shown).

Figure 9:
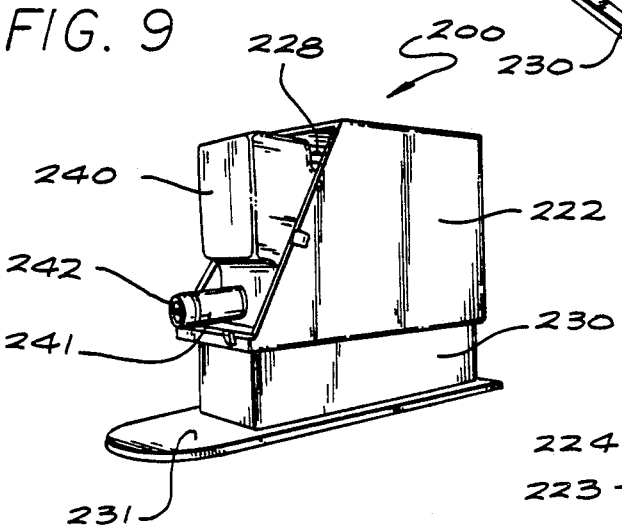
FIG. 9 shows the placement of a plastic water bottle into the countertop cooler of FIG. 7.

FIG. 9 shows the unit 200 with front cover section 221 removed, exposing water bottle 240.

Figure 10:
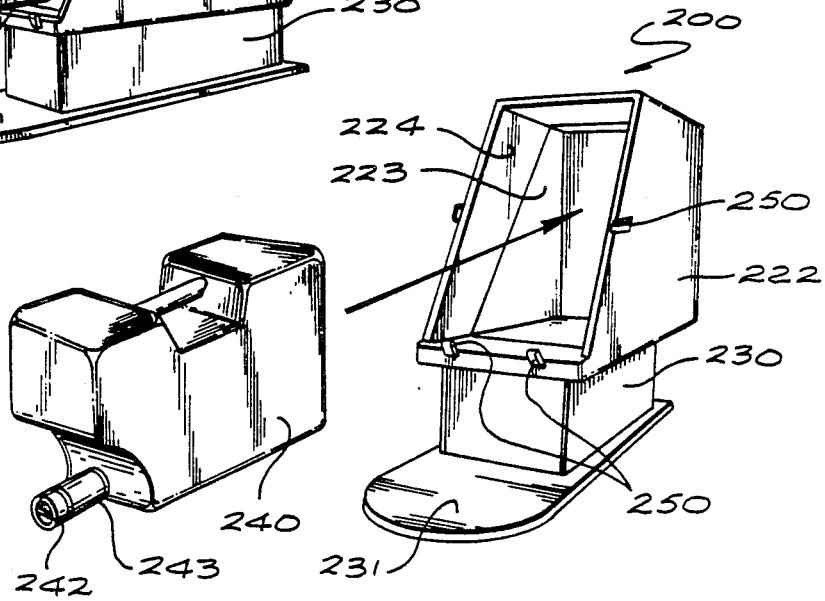
FIG. 10 illustrates a typical commercially available plastic water bottle shown as it would be mounted into the countertop cooler of FIG. 7.

FIG. 10 shows the entry of water bottle 240 into rear half 222, wherein conductive surface 223 cools the water, while insulation 224 maintains the water's temperature. In FIG. 10, the plastic liner is not shown for clarity in noting the shape of the partial box configuration of the aluminum member 223, which extends along the rear and substantial portions of adjacent wall or walls, and may include sides and/or the bottom of the unit.

Figure 11:
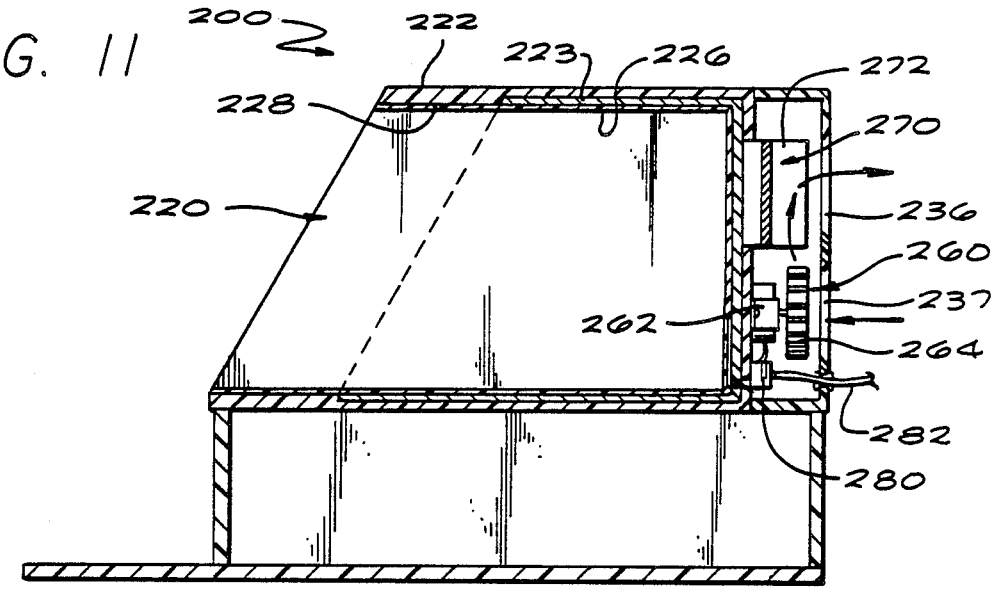
FIG. 11 is a side view in cross-section illustrating the use of a centrifugal fan to assist in cooling the fins of the thermoelectric cooling unit.

FIG. 11 is a view in cross-section of unit 200, illustrating the position of thermally conducting liner 226, and metal conductive cooling member 223 within rear enclosure 222, and the position of thermoelectric device 270 in intimate contact with metal conduction member 223. The thermoelectric cooling device 270 is provided with a centrifugal fan system 260, which brings air in by fan 264 through opening 237 and out through opening 236, drawing the heat from the rear fins 272 of thermoelectric cooling unit 270.

Figure 12:
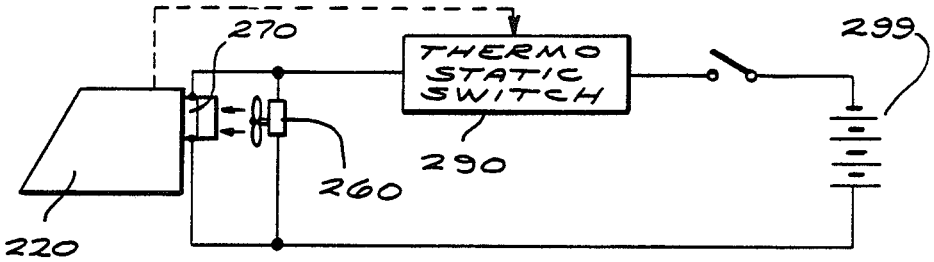
FIG. 12 is a schematic drawing of an electric circuit which may be employed in powering the thermoelectric cooling unit, and to maintain the degree of cooling at a predetermined temperature.

FIG. 12 is a schematic circuit diagram, showing cooler 220, the thermostatic switch 290, fan 260, thermoelectric cooling device 270, and a direct current power source 299. Instead of using battery 299, a step-down transformer and rectifier may be used.

Figure 13:
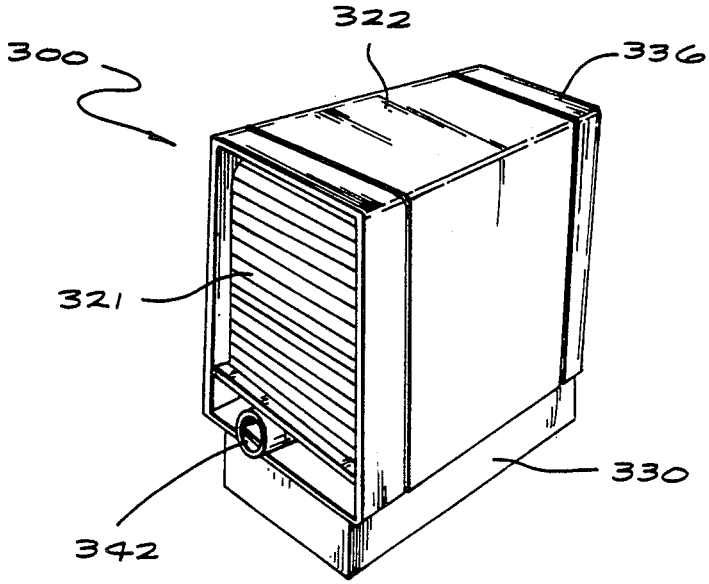
FIG. 13 shows a ribbed front incorporated in an alternative embodiment of a countertop cooler.

FIG. 13 is another alternative embodiment of the current invention 300 wherein the water bottle 340 (not shown) slides into section 322 and a closure 321 rolls down and closes the opening into which water bottle 340 slides. The closure 321 may be formed of a series of coupled slats as are used in a roll top desk.

FIGS. 14 and 15 show the multi-purpose positioning and locking provisions of lock handle 50, which may be used with the unit of FIGS. 1–4. More particularly, FIG. 15 shows the handle 50 in various positions. Position "A" is vertically oriented at 90° to base 31, and handle 50 holds upper section 25 in place by means of the contact of flanges 101 and 102 as shown in FIG. 14. Position "B" for lock handle 50 locks upper removable section 25 into place by means of the intimate contact of lockbar 54 with recess 55 in the front upper corner of removable section 25. Position "C" which is oriented at 90° relative to position "A" secures upper section 25 and allows for the easy sliding, pushing and pulling of the unit by handle 54 when in this position, with flange 103 on handle 50 interfitting with flange 104 on the upper portion 25 of the cooler case. Rotation through position "D", with clearance past spigot 42, allows the removal of upper section 25. It should be noted that in embodiment 100, utilizing a conventional refrigeration system, lock handle 50 as shown here in positions "A" and "C" could be an off position for a control switch for refrigeration unit 150. A rotary switch, mounted in handle mounting bosses 56 and 57 in unit 20, could activate the refrigeration unit 150 only at position "B". Additionally, position "D" in the conventional refrigeration system as shown by embodiment 100 would also trigger "Turn-off" the refrigeration unit 150 and allow removal of the upper removable unit.

FIG. 16 is another alternative embodiment, with the countertop unit 400 both cooling and heating water. The unit 400 would approximately be double the width of a cooling unit as shown in the prior embodiments. Cold water bottle 440, hot water bottle 410, in this front view would have the positions of hot and cold water handles on traditional water faucets. An additional section of insulation 425, separates the two bottles to prevent any loss of heat from bottle 410 or introduction of heat into bottle 440. Alternative embodiment 400 utilizes a single thermoelectric device to both cool bottle 440 as well as to heat bottle 410, so that the external fins and cooling arrangements shown on other embodiments are not needed. Separate thermoelectric units may also be used individually for the hot and cold units.

Figure 17:
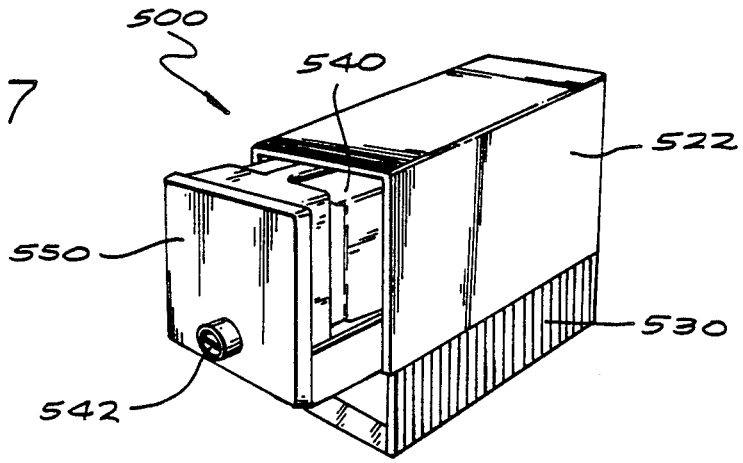
FIG. 17 is a countertop cooler which provides a sliding draw mechanism for removal and insertion of said plastic water bottle.

FIG. 17 shows an additional alternative embodiment of the invention herein, wherein the water bottle 540 is held on a drawer 550 which slides closed into enclosure 522. The cooling system is incorporated into the area of base 530 and could be either traditional or thermoelectric.

Figure 18:
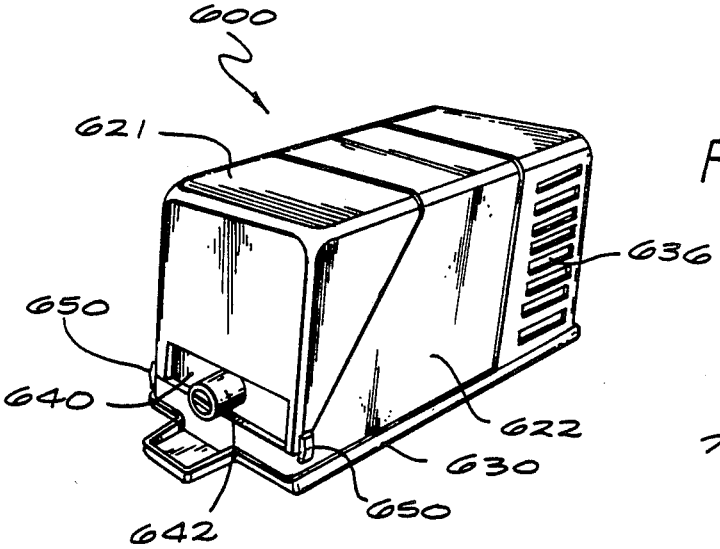
FIG. 18 is an embodiment of a countertop cooler with a conventional compression type cooling unit in the rear, and allowing a view of the water level.

FIG. 18 represents an additional alternative embodiment 600, wherein front section 621 sits on rear section 622. The bottle fits into bottom plate section 630. The cooling unit is in rear section 636. Unit 600 is contemplated as utilizing a traditional refrigeration system to cool the water; however, a thermoelectric unit may be employed.

Figure 19:
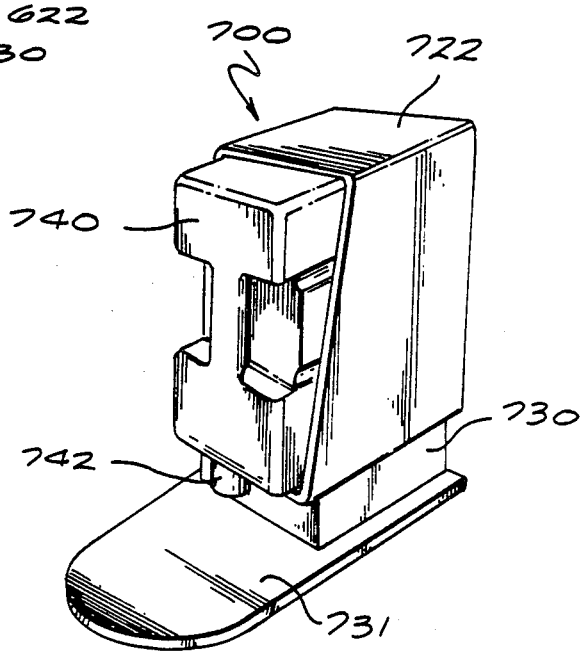
FIG. 19 is an embodiment of a countertop cooler with the cover removed, and which holds the plastic water bottle in a vertical orientation.

FIG. 19 shows another alternative embodiment 700 of the invention herein. Water bottle 740 is held in a vertical position in housing 722 mounted on base 730 and base plate 731. The position of bottle 740 provides for improved gravity water flow. A cover, not shown, encloses the front of the unit. This unit is preferably thermoelectrically cooled.

FIG. 20 is the cutaway rear section of a countertop cooling unit 900 using a thermoelectric cooling device 970 without a fan. The thermoelectric device 970 in the rear of unit 900 has ambient air flowing through opening 978 and through fins 971, to remove or carry off the heat generated by the thermoelectric unit 970. No fan is needed in view of the substantial exposed surface area of fins 971.

FIG. 21 is a schematical cross-sectional view of an embodiment of the current invention, wherein plastic water bottle 840 is held stationary within cavity 828. A large removable screw type cap 843 is provided. The cap may be two or three inches in diameter. Iced tea, water or other drinks are introduced into the container through opening 844, after removal of cap 843. This unit is envisioned for use in camping, as well as in areas in the country where bottled water is not sold in the type of container noted herein.

Reference will now be made to FIG. 1 and the thermoelectric cooling device unit 70. Thermoelectric cooling devices such as 70 operate as a solid state heat pump. The cold junction of the device is that junction which will absorb or remove heat from an intended "cold surface" such as inner conductive surface 26. The heat absorbed at the cold junction, which is in intimate contact with a thermally conductive member such as aluminum member 23, is pumped to the hot junction at a rate proportional to the current passing through the circuit. Thermoelectric cooling couples may be made using two elements of semiconductors, such as Bismuth Telloride, heavily doped to create either an excess (N type) or deficiency (P type) of electrons. Current flowing through a series circuit will cool one junction and heat on another junction in accordance with known thermoelectric principles.

The hot junction will usually be a large metal or other heat conductive material which may diffuse the heat. In FIG. 1, housing 72 and chamber 74 in combination with fan system 60 conduct the heat away from the hot junction. The thermoelectric device can be attached with the hot junction in contact with a conductive member in which a water bottle is held in intimate contact therewith, in order to heat the water. Such a configuration is utilized for the hot water section 410 of embodiment 400, see FIG. 16.

The conductive member, such as 23, would preferably be made from either aluminum alloys or magnesium alloys, or other goods thermal conductors could be used. The conductive members could also be multi-layered composites of various material compositions or composed of a single material high thermal conduction properties.

The embodiment of FIG. 1, is envisioned for use both in the kitchen, as well as on the go. As shown in position "A" of FIG. 15, the lock handle 50 in position "A" will lock upper removable section 25 in place with lower section 27 and allow carrying of the unit by the handle. The intimate contact and overlay of locking flanges 101 and 103 (not shown) of lock handle 54 onto lock flanges 102 and 104 (not shown) on upper removable section 25 will ensure the secure closure of enclosure 21. The embodiment in FIG. 1, as others herein, are contemplated to also be able to run on batteries. The batteries would run the cooling device, such as 70, and allow for a truly portable unit. The small size of the unit will permit its use on long trips, camping, and for picnics. The units may of course be operated from car or camper batteries.

The outer surfaces will be constructed of thin walled molded lightweight plastic with the insulation between the outer surface and the inner surface conductive member to be lightweight insulation. The base and base plate if desired, could also be of lightweight molded plastic, lightweight aluminum alloys, or magnesium alloys with the thickness being sufficient to support the enclosure.

The embodiments shown herein and any alternatives are envisioned for use with a battery pack to supply power to either the thermoelectric cooling system or a traditional refrigeration system. Such battery operation will show a continuous operation of the countertop cooling unit as well as its potential portable uses on long trips and for camping environments, particularly when power is available from automotive vehicles or marine craft.

All embodiments are contemplated to have a height of no more than 15½ inches. The typical distance from the countertop to beneath the typical kitchen cabinet is approximately 16 inches. All embodiments of the countertop cooling unit are envisioned to be placed on a countertop underneath the cabinet in a typical kitchen; utilizing a minimum amount of counterspace.

Having thus described preferred exemplary embodiments of countertop cooling units that illustrate the present invention, various alternatives may be implemented. Thus, by way of example and not of limitation, liquids other than water may be cooled, and bottles other than 2½ gallon bottles may be cooled. Various other modifications, alterations and adaptions thereof may be made within the scope of the present invention which is defined by the following claims.

What is claimed is:

1. A liquid chiller or countertop cooler for standard size water bottles or the like comprising:

an enclosed refrigeration case for removably receiving and closely enclosing a plastic water bottle approximately 6 inches wide, 12 inches deep, and 10 inches in height, said bottle having a dispensing spigot mounted at the lower front end thereof;

said case including a base, said enclosed case having a lower section fixed to said base and a fully removable top section including a portion covering more than one-half of the top of said bottle, and most of the front thereof, to permit placement of said bottle in said enclosed refrigeration case and to allow for the removal of said bottle therefrom;

means for mounting said removable section in place to enclose said refrigeration case;

a thermally conductive metal member covering the inner rear of said case, and extending along at least a substantial portion of the inner rear of said case, and at least one adjacent inner wall of said refrigeration case, to cool said bottle by conduction;

thermoelectric cooling means mounted at the rear of said refrigeration case and in intimate thermal conductive relationship with said conductive metal member for cooling the water in said bottle; and said refrigeration case including a spigot receiving opening extending through the front wall of the lower fixed section thereof, whereby the bottle must be placed into said countertop cooler with the spigot being initially engaged through said opening before the remainder of the bottle can be placed into said cooler.

2. The device according to claim 1, wherein the spigot extends from the plastic bottle through the refrigeration case permitting the withdrawal of said water from said bottle.

3. The device according to claim 1, wherein said means for securing said removable section in order to close said refrigeration case is a multi-positioned locking handle having side arms and a central lockbar;

said handle's side arms being mounted to said case at respective side mounting brackets;

said brackets allow the rotational movement of said handle about said refrigeration case;

said rotation of said handle will engage said refrigeration case at various lock and unlock positions;

said lock positions including means for securely holding in place said removable upper section of said refrigeration case;

said handle having a front lockbar intimately contacting said upper section at a fixed position to secure upper section;

means including mating tabs on said side arms and said case for securely holding said removable sections in place at positions which will permit the pushing and pulling of said cooler into place as well as allow for carrying of said case;

said handle and mounting brackets being constructed to include means for carrying, pushing and pulling of said cooler.

4. The device according to claim 1, wherein means are provided for controlling the temperature of the water by a thermostatic switching device.

5. The device according to claim 1, further comprising:

a battery pack to operate said thermoelectric cooling means, cooling the water in said refrigeration case.

6. A liquid chiller or countertop cooler for standard sized water bottles or the like comprising:

a plastic water bottle approximately 6 inches wide, 12 inches deep, and 10 inches in height;

said plastic bottle having a spigot mounted on said bottle at the lower front end thereof;

a refrigeration case which closely encapsulates said plastic water bottle, said case having a fully removable upper portion and a lower fixed portion;

said case having a cooling means for conductively cooling said water and said plastic water bottle;

said case having a multi-layered material construction which incorporates in its interior in intimate contact with said plastic water bottle, a thermally conductive metal liner, extending across the back and at least one adjacent wall of said cooler;

incorporated within the walls of said case, as the layer contacting said interior, is insulated material which prevents the loss of coolness from the water in said plastic water bottle;

the exterior of the case being comprised of rigid dense material of sufficient structural strength to support and enclose said plastic water bottle, said water therein, said insulation, and said metal liner; and said refrigeration case including a spigot receiving opening toward the front of the lower fixed portion thereof, whereby the bottle must be placed into said countertop cooler with the spigot being initially engaged through said opening before the remainder of the bottle is placed into said cooler.

7. The invention according to claim 6, further comprising:

a refrigerating cooling system which incorporates an evaporator, a compressor, and a condenser which is activated by said locking handle's positional placement;

when said handle is positioned to allow removal of said removable upper section and then said water bottle, that position of said handle deactivates said refrigeration cooling system;

incorporated within handle and mounting bracket is a rotary switching means for operational control of said cooling system.

8. The invention according to claim 7, wherein said evaporator is incorporated within the side walls of said case, with the condenser coils on the rear exterior of the rear of the case, and the compressor mounted within the base beneath said case.

9. The device of claim 7, wherein means are provided for controlling the temperature of the water by a thermostatic switching device.

10. The device according to claim 6, wherein said water bottle at its top has an opening which permits the entry of potable liquid and a cap which removably closes said opening.

11. The device according to claim 6, wherein said case is an enclosure for removably receiving said bottle;

the case including a base, said case having a removable section including a section covering more than one-half the top of said bottle, and most of the front thereof, to permit placement of said bottle in said enclosed case and removal of said bottle therefrom;

means for securing said removable section in place to close said case.

12. The device according to claim 6, wherein said means for securing said removable section in place is a multi-positional handle;

said handle having the construction of a lockbar parallel to said front top and back surfaces of said case, and two side arms which run from the ends of said lockbar perpendicular to the lock bar and extending along the sides of said case and attaching to mounting brackets within the side walls of said case;

said brackets including means for allowing positional rotation of said handle to various lock and unlock positions.

13. The device according to claim 6, wherein said handle and brackets constitutes means for carrying the countertop cooker.

14. The device according to claim 6, wherein said means for cooling said water in said plastic water bottle comprises a refrigerated cooling system containing an evaporator, a compressor, and a condenser in intimate thermal conductive relationship with said thermally conductive liner.

15. The device according to claim 6, wherein means for cooling said water and said plastic water bottle is a thermoelectric cooling system.

16. The device according to claim 6, further comprising:

a battery pack to supply current to operate said means for cooling said water and said plastic water bottle.

17. The device according to claim 6, wherein said case has a height no greater than 15½ inches which enable said cooling unit to fit on the counter and underneath standard kitchen cabinets.

18. The device according to claim 6, comprising:

a thermostatic control means for controlling the temperature of the water in said cooler by controlling the electrical circuit of the cooling means therein.

19. The device according to claim 6, comprising:

a case which encloses two standard plastic bottles of water, holding approximately 2.5 gallons of water, separated by thermal insulation with each having its own conductive metal member partially encapsulating said bottles, and incorporated into one enclosed case;

each plastic bottle having a spigot at the lower front end thereof to allow the flow of said water from said plastic bottle;

each case will have a conductive metal surface member and said liner with each water bottle; and means for cooling one of said bottles and heating the other of said bottles by a single thermoelectric device having the cool junction thereof connected to one said metal surface member and the hot junction thereof connected to the other metal surface member.

20. A liquid chiller or countertop cooler for standard sized water bottles or the like comprising:

a plastic water bottle approximately 6 inches wide, 12 inches deep, and 10 inches high;

a spigot mounted on said bottle at the lower front end thereof;

an enclosed refrigeration case for removably receiving and closely enclosing said bottle in place including a base and enclosed case having a fixed section and a removable section including a section covering more than one-half of the top of said bottle and most of the front thereof, to permit placement of said bottle in said enclosed refrigeration case and to allow for the removal of said bottle therefrom;

a rotational locking handle securing said removable section in order to close said refrigeration case;

a metal conductive cooling member at the inner rear of said case, extending along at least a substantial portion of at least one adjacent wall of said refrigeration case, to cool said bottle by conduction; and a thermoelectric cooling device, which withdraws the heat from said water;

said device being mounted on the rear of said refrigeration case;

a fan system to assist in expelling said heat by airflow through the rear of said case; and thermostatic control switch means to control the water temperature to be maintained in said refrigeration case.

21. A system as defined in claim 20 wherein said refrigeration case includes a spigot receiving opening toward the front of the lower fixed section thereof, whereby the bottle must be placed into said countertop cooler with the spigot being initially engaged through said opening before the remainder of the bottle is placed into said cooler.

* * * * *